United States Patent [19]

Steinhauser

[11] 3,994,403

[45] Nov. 30, 1976

[54] GRIPPING DEVICES FOR MULTI-STAGE UPSETTING PRESSES

[75] Inventor: Ulrich Steinhauser, Allschwil, Switzerland

[73] Assignee: Hatebur Umformmaschinen AG, Basel, Switzerland

[22] Filed: July 17, 1975

[21] Appl. No.: 596,800

[30] Foreign Application Priority Data

July 18, 1974 Germany ..... 2434540

[52] U.S. Cl. ..... 214/1 BB; 294/118; 269/218; 269/238; 269/321 ME; 10/12 T

[51] Int. Cl.[2] ..... B25B 5/04; B65G 61/00; B21K 1/44

[58] Field of Search ..... 214/1 B, 1 BB, 1 BC, 214/1 BD; 294/106, 118; 269/225, 227, 237, 238, 233, 239, 218, 321 ME; 10/11 T, 12 T, 72 T, 76 T

[56] References Cited

UNITED STATES PATENTS

| | | | |
|---|---|---|---|
| 1,213,574 | 1/1917 | Baash | 269/218 X |
| 1,910,833 | 5/1933 | Hippey | 269/218 X |
| 2,688,144 | 9/1954 | Berkey et al. | 269/218 X |
| 2,942,719 | 6/1960 | Bofinger et al. | 269/321 ME |
| 3,129,822 | 4/1964 | Bower | 214/1 BB |
| 3,143,217 | 8/1964 | Andersen | 214/1 BB |
| 3,154,801 | 11/1964 | Byam | 214/1 BB X |
| 3,258,136 | 6/1966 | Rockstrom et al. | 214/1 BB |
| 3,298,541 | 1/1967 | Alexon | 214/1 BB |
| 3,805,944 | 4/1974 | Yuryan | 214/1 BB X |
| 3,873,145 | 3/1975 | Adkins et al. | 294/118 X |

*Primary Examiner*—Robert S. Ward, Jr.
*Attorney, Agent, or Firm*—Neil F. Markva

[57] ABSTRACT

A gripper device comprises a gripper carrier which reciprocates towards and away from an upsetting station in a multi-stage upsetting press and at least one gripper for carrying workpieces. Each gripper comprises a pair of guide elements on the carrier and a pair of gripper arms each pivotally connected to a respective one of the guide elements to be driven thereby. The gripper arms are pivoted to one another at a point which is triangularly spaced from the points at which the arms are pivoted to the guide elements. The guide elements are arranged so that as the arms open to deposit a workpiece, they are moved bodily upwards in order to clear the upsetting station, the upward motion being at a minimum as the arms start to open and increasing steadily as the motion proceeds.

21 Claims, 16 Drawing Figures

Fig. 5
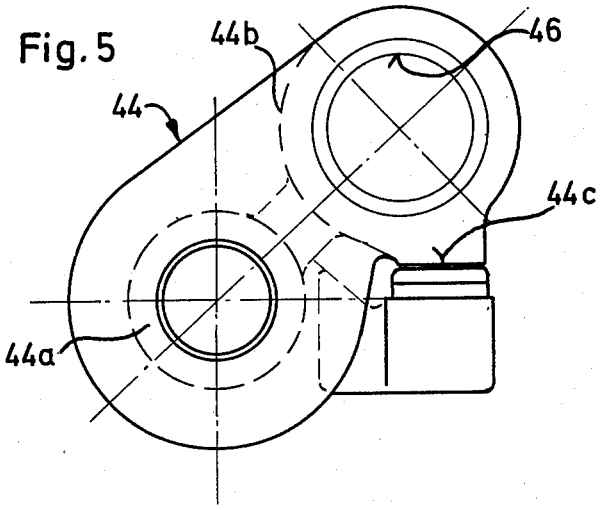
Fig.6
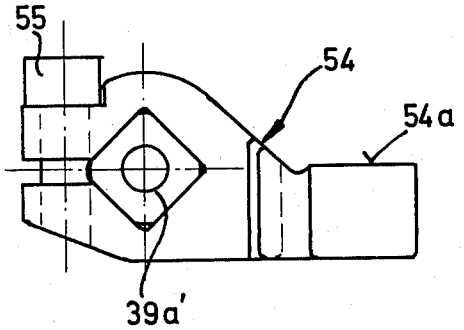
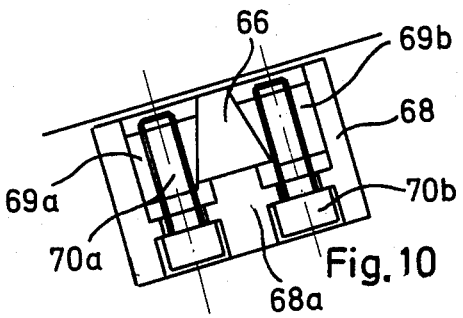
Fig. 10
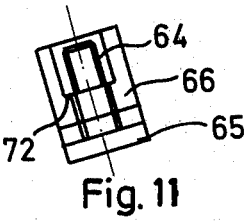
Fig. 11

VIII
62
63
42
32
43
16
15
30
5
31
6
α
68
3
38
67
1
2
66
25a
X
25b
X
XI
65
XI
71
64
64
P
VIII

GRIPPING DEVICES FOR MULTI-STAGE UPSETTING PRESSES

The present invention relates to a device for gripping a workpiece as it is carried from one upsetting station to another on a multi-stage upsetting press. More particularly, the invention is concerned with a type of gripping device which comprises at least one two-armed gripper arranged on a gripper carrier and, which, conjointly with the latter, carries out a reciprocating translatory motion in a direction which is at least approximately at right angles to the direction of operation of the upsetting tools, each gripper also being forced at the same time, during the travel between the two adjacent upsetting stations, to carry out a deflected motion at right angles to the translation, on which motion a periodic opening and closing motion is superimposed.

As is known, multi-stage upsetting presses of this type are high-performance machines which operate automatically and which process wire or bar stock, which is continuously fed in, in a non-chipping manner in one shearing-off step and several successive press steps. During this operation, the pressing which is separated from the wire or bar stock at the shearing-off station is conveyed from one upsetting station to the other by means of an automatically controlled transverse transport device.

Of course, this transverse transport of the pressings requires a very high degree of co-ordination in time and place. A particular difficulty is that although it is desirable that, after setting down a pressing, the grippers should return into their initial positions immediately, as far as possible, in order to grasp the next pressing, the punch or upsetting tool obstructs this transverse motion. Since the known transport tongs with intersecting tong jaws can only carry out an expansion, but not an additional lifting motion, the empty return must wait until the retracting punch clears the path. The time loss thus caused is considerable and is no longer acceptable with the now customary throughputs of, for example, 100 parts per minute.

It has already been proposed in order to overcome this difficulty, to hinge the ends of the two gripper arms of each gripper to a slide on the carrier which slide reciprocates at right angles to the longitudinal motion of the carrier, two linkages engaging at approximately the middle of the grippers and the other ends of these linkages together being hinged to a centre of rotation of the carrier slide.

With this arrangement, the grippers carry out, with respect to the stationary machine frame, a combined motion which is composed of three motions superimposed in time:

A translatory motion with the carrier slide between the upsetting stations, which motion imparts to all the grippers a reciprocating motion, the stroke length of which corresponds exactly to the mutual distance of two adjacent upsetting stations, a periodic opening and closing motion of the grippers which serves to grasp or release the pressings and a deflected motion which takes place at right angles to the direction of motion of the carrier slide and which permits the gripper to pass unhindered by the as yet unretracted punch.

This involves the provision of each gripper with a mechanically actuated slide, the inertia and relatively complicated design of which places a large burden on the functioning of the transverse transport device and, furthermore, considerably increases the cost of the entire installation. This design of slide also does not permit desired variations of the coupling curve of the motion of the grippers, that is to say an adaptation to different working conditions e.g. different shapes or sizes of workpiece.

According to the present invention, there is provided a device for transporting workpieces between upsetting stations in a multi-stage upsetting press, such device comprising a gripper carrier mounted for reciprocating translatory motion towards and away from an upsetting station, the translatory motion being in a direction at least approximately at right angles to the direction of operation of an upsetting tool at the upsetting station, the gripper carrier having at least one gripper for carrying workpieces to the upsetting station, the or each gripper comprising a pair of gripper arms movable towards and away from each other to grip and release a workpiece, each gripper arm having at one end thereof means for gripping a workpiece and at the other end thereof a pivot point at which the arm is pivoted to an associated respective guide element, the gripper arms being pivotally connected to one another about a common pivoting axis at a location intermediate their ends, which is in triangularly spaced relation to the pivot points of the arms, the guide elements being arranged positively to guide the pivot points to open and close the arms in such manner that as the gripper arms open to deposit a workpiece at the upsetting station, they undergo a translatory motion in a direction generally perpendicular both to the translatory motion of the carrier and to the direction of the operation of the upsetting tool, which translatory motion of the arms is at a minimum as the arms start to open and thereafter increases steadily as the opening motion proceeds.

This arrangement results in a very simple construction of the moving parts. The coupling curve of the motion of the gripper arms can be varied to any desired extent by a simple displacement of the hinge points of the gripper arms.

In one special embodiment, the said guide elements are cranks, one of which is driven in the sense of a periodic pivoting, whilst the other is biased, in the sense of a closing motion of the gripper arms, by means of an elastic element, preferably a spring, in such a way that the two cranks perform a rotational movement in opposite senses, the direction of rotation changing periodically.

In this embodiment, the guide elements may be formed with intermeshed toothed segmental circular portions which are pivoted to the gripper carrier. With this arrangement, it is preferred that the arrangement is such that when the gripper arms are in their closed position, the common pivoting axis of the gripper arm is colinear with the pivot point of each gripper arm and the pivot point of its associated guide element.

Preferably, with the gripper arms in their closed position, the lines connecting their respective pivot points with the common pivot axis should be approximately mutually perpendicular.

The invention will be further described with reference to the accompanying drawings in which:

FIGS. 5 and 6 show details of the drive;

FIG. 10 is a section along the line X—X in FIG. 7;

FIG. 11 is a section along the line XI—XI in FIG. 7;

Figure 1:
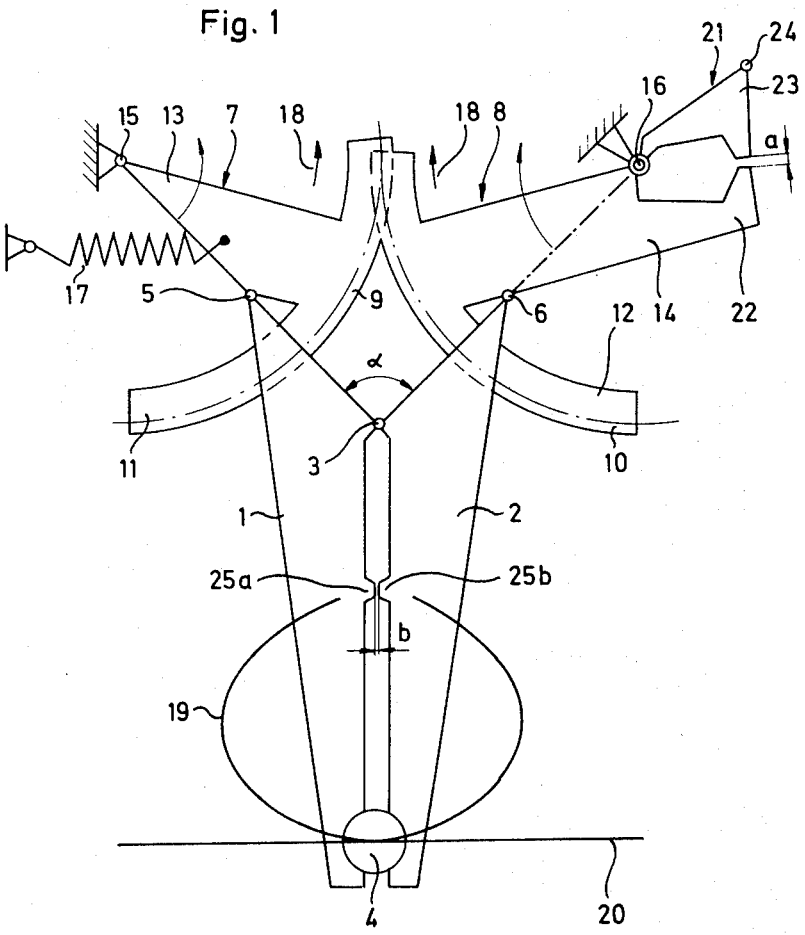
FIGS. 1 – 3 are diagrammatic representations of an embodiment of the present invention in three different phases of motion.
Figure 2:
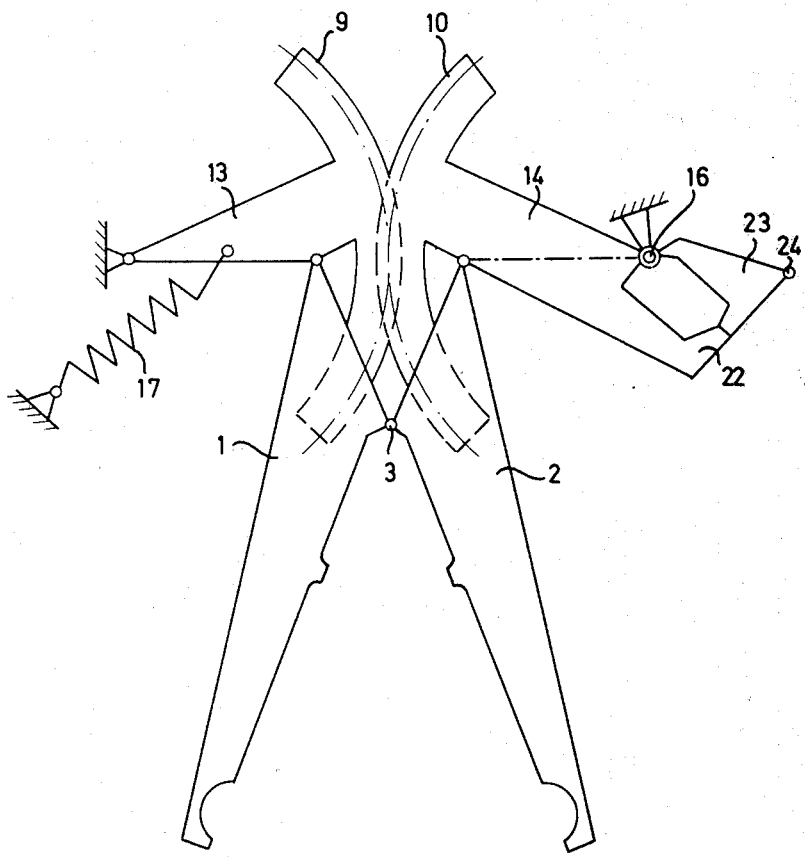
Figure 3:
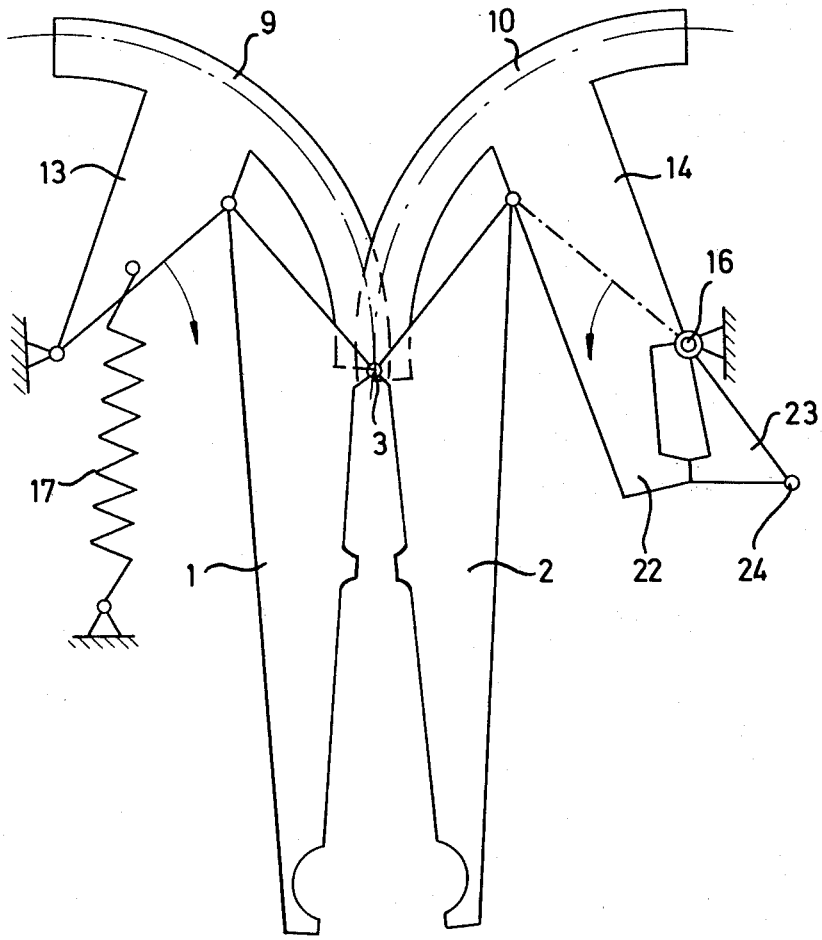

The gripper mechanism represented diagrammatically in FIGS. 1–3 possesses two gripper arms 1 and 2 which can pivot about a common pivot 3. The lower end parts of the gripper arms enclose a pressing 4, which they have just transported, for example, to a point in front of the matrix opening of an upsetting station, in order to deposit it where it is pushed into the matrix by the punch and is thus upset. The gripper comprising the two arms 1 and 2 is mounted, on a gripper carrier which is in itself known and, therefore, not shown in FIGS. 1–3 and which, in the region of the upsetting stations, carries out a periodically reciprocating motion (in a straight line or in a curved line), the stroke length of which exactly corresponds to the mutual distance of two adjacent upsetting stations.

The upper ends of the gripper arms 1 and 2 are pivoted to respective guide elements 7 and 8 by means of pivots 5 and 6. Each guide element 7, 8 has a segment 11, 12 which is provided with peripheral toothing 9, 10 and which can be rotated within limits around an axis 15, 16 by means of a spoke 13, 14.

The guide element 8 is driven in such a way that it carries out a periodic pivoting motion through an angle which is smaller than 90°, the two toothed rims 9 and 10 meshing with one another so that the guide element 7 is driven in the opposite rotational sense. A tension spring 17 engages the guide element 7 so that the closure of the gripper takes place by means of the spring force, that is to say in a non-positive way, whereas the opening of the gripper is effected positively by the drive to guide element 8. By appropriately designing the drive, it would, however, also be possible to control the opening non-positively and the closure positively or to control both motions positively.

As shown in the drawing, when the guide elements 7 and 8 are rotated, the gripper arms 1 and 2 are carried along in the direction of the arrows 18, in such a way that the lower ends of the gripper arms approximately follow the coupling curve 19, drawn in FIG. 1, which can be regarded as a superposition of the opening motion and of a lifting motion. Both motions are necessary: the first for releasing the pressing and the second for by-passing the punch. The part of the coupling curve 19 corresponding to the commencement of the opening sequence of the arms 1, 2 should run at right angles to the pressing axis so that the vertical component of this motion is zero; as a result of this, the position of the pressing is not altered when the jaws of the arms are lifted off.

This condition is fulfilled in the embodiment represented since, on the one hand, the pivots 3, 5 and 15 and, on the other hand, the pivots 3, 6 and 16 are in a straight line in the rest position, in accordance with FIG. 1. Accordingly, the path tangent 20 at the coupling curve is horizontal at the start of the opening motion and the increase of the vertical component is, as FIG. 1 shows, at first so small that the gripper arms can disengage the pressing without disturbing the latter. As the rotary motion of the guide elements 7 and 8 proceeds, the vertical component then becomes predominant, as shown in FIG. 1, so that the lower ends of the gripper arms are then rapidly lifted up.

The angle $\alpha$ enclosed between the lines connecting pivots 3 and 5 and 3 and 6 respectively is preferably 90° when the gripper arms are closed; the effects of geometrical errors are, therefore, equal, relative to the positon of the pressing, both in the vertical sense and in the horizontal sense.

FIGS. 2 and 3 show the same gripper mechanism in later phases of the retraction of the gripper arms. After release of the pressing, the gripper ends at first extend, whilst simultaneously being lifted up, up to the maximum extended position according to FIG. 2, the pivots 15, 5, 6 and 16 lying in a horizontal line.

The angle $\alpha$ in this position of maximum separation of the arms should be greater than 0, to ensure positive drive of the gripper arms.

In the phase of motion shown in FIG. 3, the gripper arms have reached the highest position. From here, the motion is reversed in order to grasp the next pressing.

The drive of the installation described is, for example, effected by means of a mechanism which is designated as 21 in FIGS. 1 – 3, which is here represented only diagrammatically in order to illustrate its operation and the design details of which will be described thoroughly in connection with FIGS. 4 to 6 and 9.

According to FIGS. 1 to 3, the end section of the guide element designated as 8 is shaped as a dog 22. This dog 22 lies within the range of motion of a rocking lever 23 which can pivot around the stationary axis 16 and is linked to a drive element, which is not shown, via a hinge 24. The rocking lever 23 carries out a periodic rocking motion around the axis 16 under the action of this drive element and in doing so each time strikes the face of the dog 22, which is towards the rocking lever, so that the guide element 8 is moved in the direction of the righthand arrow 18, the guide element 7 is taken along by means of the toothing 9/10 and the gripper 1/2 is opened and lifted up.

FIG. 1 shows that, in the closed position illustrated, in which the gripper arms 1 and 2 enclose the pressing 4, a clearance $a$, which is greater than the distance $b$ of two stops 25$a$ and 25$b$ formed on the insides of the gripper arms 1 and 2, is provided between the rocking lever 23 and the dog 22. In this way, the spring 17 acts, via the gripper arms, on the pressing so that the latter is held firm.

FIGS. 4–9 show the actual construction of this embodiment in a simplified form.

Figure 4:
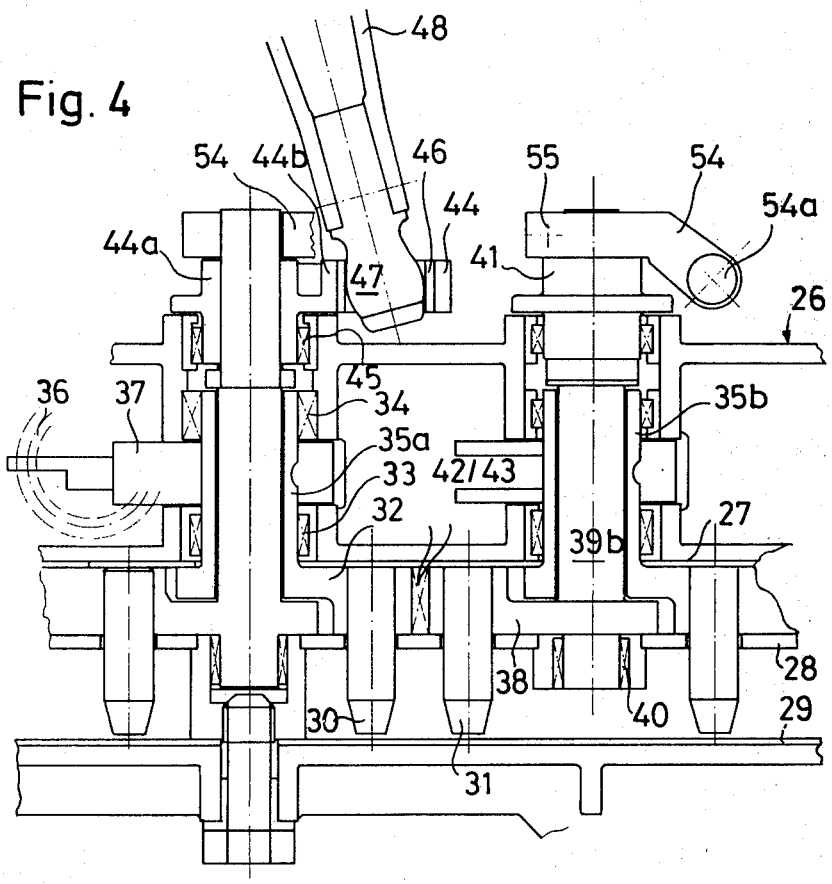
FIG. 4 is a simplified horizontal section of the embodiment shown in FIGS. 1 – 3.

The horizontal section according to FIG. 4 shows a gripper carrier 26, which can move in its bearings in the press frame and which is coupled to a drive which gives it a periodic reciprocating motion. The object of this gripper carrier is to move each of the grippers, arranged thereon next to one another, from one upsetting station to the adjacent station and back again. These grippers which each consist of two co-operating gripper arms must be so designed and controlled that they enclose the pressing after a first upsetting phase, transport it to a point in front of the matrix of the adjacent upsetting station, release it there and return again to the initial station. Three parallel guide walls 27, 28 and 29 (FIGS. 4 and 8) which serve to guide the gripper arms 1 and 2 are fastened to the gripper carrier 26. The upper end of each gripper arm 1 or 2 is loosely slipped over a pin 30 or 31 and is held in this position by the front guide wall 29. This permits simple assembly and dismantling of the gripper arms, so that resetting times can be kept very short, if, for example, the gripper arms have to be taken out of the machine and readjusted for a new workpiece.

The pin 30 represents the crankpin of a crank, the crank arm 32 of which is rigidly connected to a hollow shaft 35*a* which is supported at 33 and 34. The hollow shaft 35*a* rests loosely, so that it can turn, in the two bearings 33 and 34, but it is continuously pulled in one direction, which corresponds to the closed position (FIG. 7) of the gripper, by means of a spring 36 which engages at the circumference of the hollow shaft 35*a* via a lever 37.

The pin 3 represents the crankpin of a further crank, the crank arm 38 of which is rigidly connected to a shaft 39*a* (or 39*b*). The shaft 39*a* is supported in bearings 40 and 45 and is, at its end part facing away from the grippers, connected to a drive mechanism yet to be described.

The shafts 35*a*/35*b* and 39*a*/39*b* are allocated to the gripper arms in such a way that two coaxially arranged shafts 35*a*/39*a* and 39*b*/35*b* belong to two different grippers, that is to say different pairs of gripper arms. The coaxial shafts 35 and 39 do not touch each other since they are separately supported. This freedom from contact of the two coaxial shafts also has the result that each shaft operates completely unaffected by the other. Otherwise, it could happen, when a gripper opens, that another gripper is moved by mutual friction of the coaxial shafts and the pressing concerned drops out of the gripper. A movement of the gripper arms by 0.2 – 0.5 mm already would suffice to cause such a fault which has serious consequences.

The two crankpins 32 and 38 already mentioned, which in this embodiment are shaped as circular segments (see also FIG. 7) and are each provided with peripheral teeth 42/43, are located in the region between the two guide walls 27 and 28. The torque of the driven shaft 39*a* (or 39*b*) is transferred to the non-driven shaft by the peripheral teeth 42/43 which mesh with one another.

As a result of the arrangement of the gripper arms between the two guide walls, as described, the axial loads occurring when the pressings are pushed in or ejected are taken up by the guide walls, so that the bearings and hinges of the gripper mechanism are largely protected.

The drive mechanism from which the periodic reciprocating motion of the gripper arms is derived can be seen in FIGS. 4, 5, 6 and 9, the arrangement in principle according to FIGS. 1 to 3 being substantially retained.

The end section, which is opposite the grippers, of each driven shaft 39*a* (39*b* and the others likewise) rests on a sleeve 44*a* which is supported by the gripper carrier 26 via a bearing 45 and is part of a dog designated as 44. This dog can thus loosely pivot around the circumference of the shaft and also has on its side, that is to say on the radially projecting arm 44*b*, a circular cylindrical bore 46 (see also FIG. 5) into which the spherical head 47 of a cam-controlled slave lever 48 protrudes.

Figure 9:
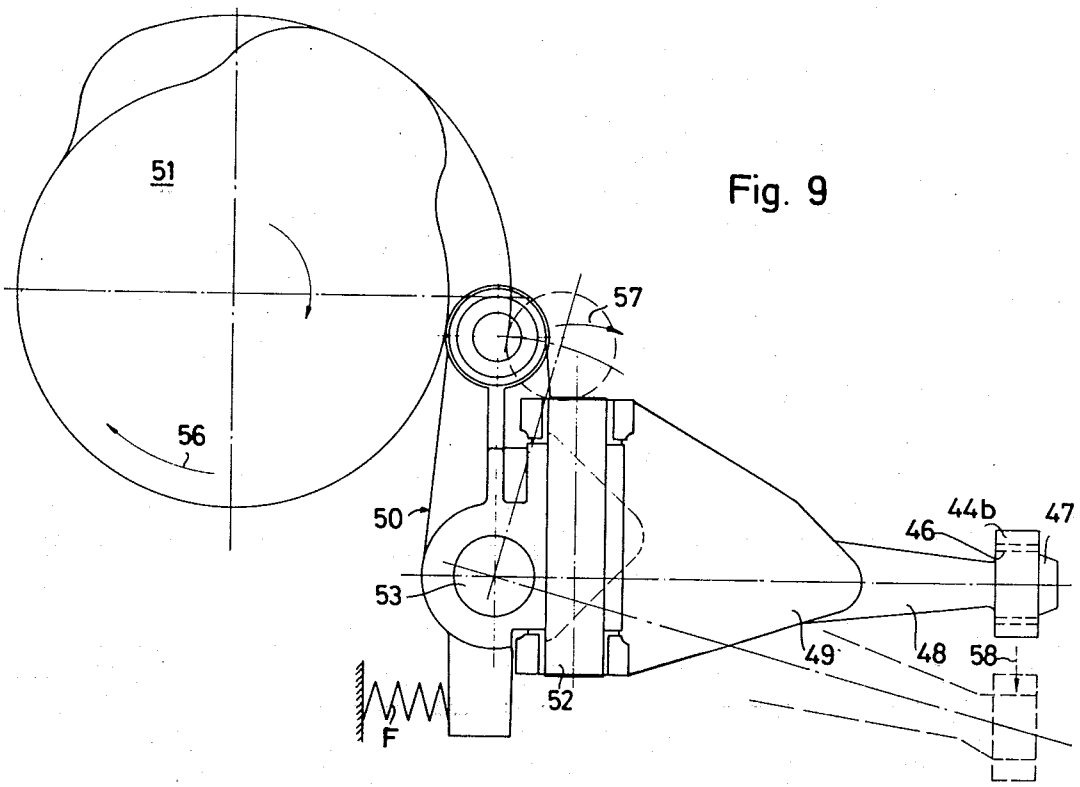
FIG. 9 is a simplified sectional representation of the drive mechanism.

The drive for the slave lever 48 can be seen in FIG. 9. The end section 49, opposite to the partspherical head 47, of the slave lever is connected, via a universal joint, to a roller lever 50 which in turn is actuated by a cam disc 51 which rotates with the stroke of the press. The two axes of the universal joint mentioned, which lie at right angles to each other, are slightly spaced apart in the construction shown and in FIG. 9 they are designated as 52 and 53. This universal joint connection enables the head 47 to follow any desired angular motion, and hence also the circular pivoting motion of the rocking lever 44.

Also, a dog 54 is rigidly joined to each shaft 39*a* (or 39*b*), adjacent to the loosely pivoted rocking lever 44. This dog 54 shaped in the form of an angular lever encloses, on the one hand, the square-shaped shaft end 39*a* and is secured in this position by a screw 55 (FIG. 6). The other section of the dog 54, which is provided with an impingement face 54*a*, is shaped and arranged so that the impingement face 54*a* is within the range of motion of the dog face 44*c* of the rocking lever 44 (FIG. 5).

This drive mechanism operates in the following way: The rotation of cam disc 51 in the direction of the arrow 56 (FIG. 9) causes, at each turn, a pivoting of the roller lever 50 according to the arrow 57, the compression spring F providing for the force closure between the roller lever and the cam. If the spherical head 47 of the slave lever 48 could move freely, it would accordingly carry out a pivoting motion in the direction of the arrow 58. The spherical head 47, however, is guided in the tube-shaped recess 46 of the rocking lever 44 and thus must turn around the axis of the shaft 39*a*, which is possible because of the universal joint linkage 52/53.

During this turning motion, the rocking lever 44 (FIG. 4) being driven in the manner described, always strikes the dog 54 which, via the shaft 39*b*, the crank arm 38 and the crankpin 31, takes along the gripper arm fastened to the latter, the corresponding motion being transferred to the other gripper arm of the pair via the toothing 42/43.

The opening motion of the grippers thus takes place under the action of the cam disc, whilst the closing of the grippers is always effected by the spring 36.

Figure 8:
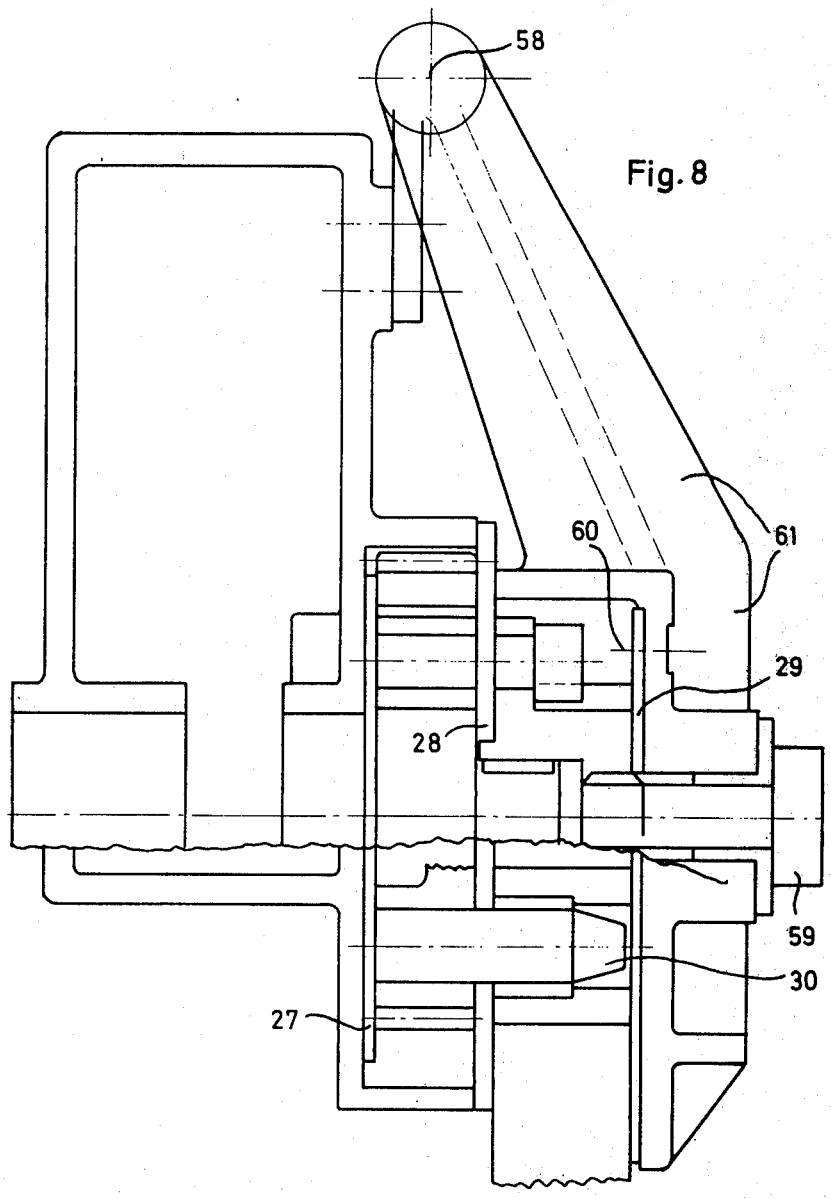
FIG. 8 is an extended section along the line VIII—VIII in FIG. 7.

As FIG. 8 shows, the front plate 29 is screwed by the screw 60 to a cover plate 61 which can readily be taken off, and can pivot around the axis 58 and be secured to the gripper carrier by means of the screws 59. In this way, the assembly and dismantling of the grippers are made substantially easier, and this ready accessibility of the grippers also offers a great advantage for occasional inspections and maintenance work. On the other hand, the gripper arms are locked away in an accident-proof and dust-tight manner, except for the free lower sections of the gripper arms, and they are securely guided also in an axial direction. On assembly, the grippers are merely slipped over the rounded pins 30, 31.

In the central guide wall 28, through which the crankpins 30 and 31 protrude, arc-shaped slots 62 and 63 (FIG. 7), the shape and position of which are adapted to the motion of the pins 30 and 31, are provided.

Figure 7:
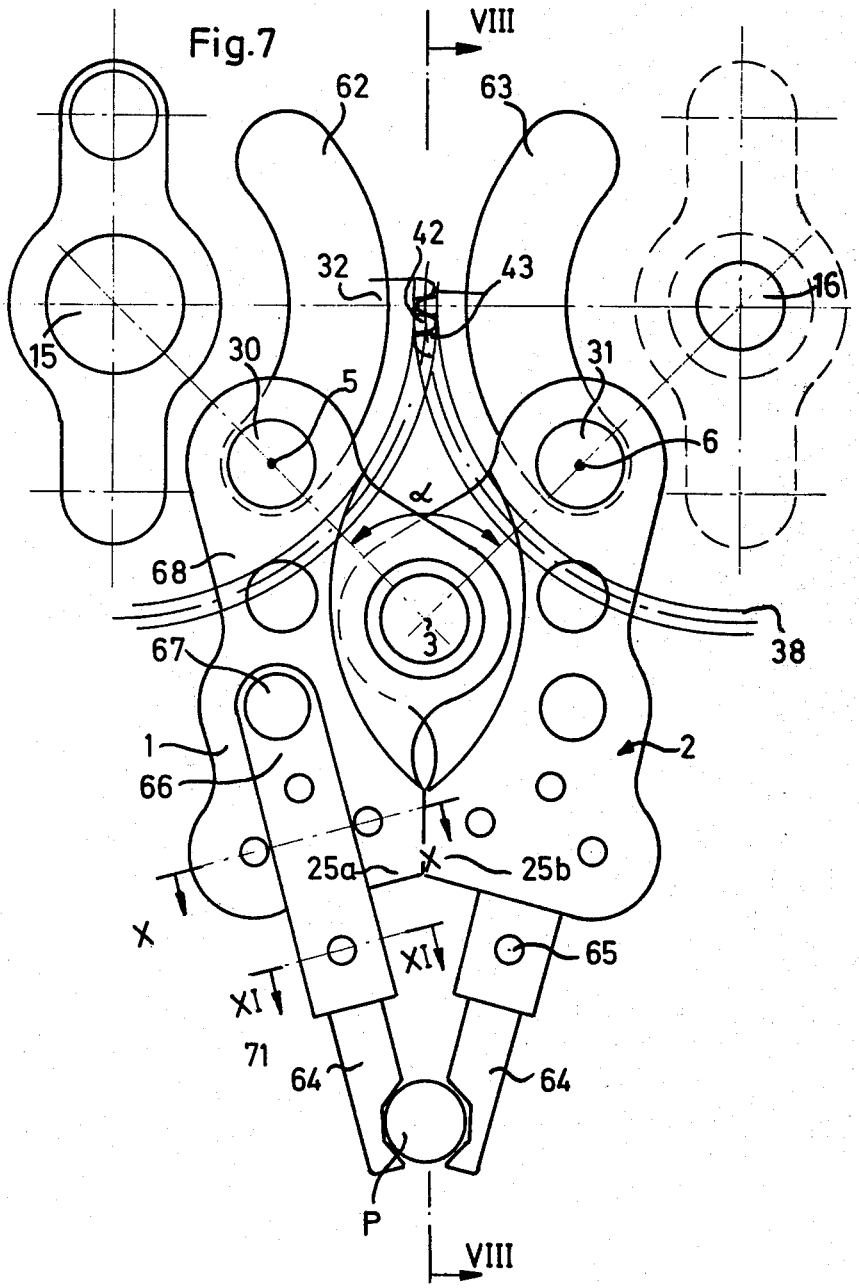
FIG. 7 is a frontal view of the gripper mechanism.

The design of the gripper arms 1 and 2 can be seen in a simplified form in FIGS. 7, 10 and 11. Each gripper arm has, in its lower section facing the pressing P, a finger 64 which is suspended in a holding arm 66 by means of a screw 65.

The holding arm 66 is suspended in the upper part of the gripper arm by means of a bolt 67 and hence can pivot around the axis of this bolt 67, and its angular position can thus be varied.

The finger 64 is clamped into a recess in the holding arm 66 by means of the screw 65 and, after this screw has been loosened, can be shifted in the direction of the axis of the gripper arm.

In this embodiment the gripper arms cannot be fitted with the known adjustment devices, since the lower sections of the gripper arms, are pulled into the interspace between the two guide walls 28 and 29 (FIG. 4) when the grippers are lifted up.

FIG. 10 shows a gripper arm 1 which has a hollow profile, and at the upper part 68 thereof has a virtually rectangular cross-section and a projecting lug 68*a*. The holding arm 66, which has a trapezoid crosssection at this point, is pressed against the upper plane face of the lug 68*a* by two adjustment keys 69*a* and 69*b*. The adjustment keys which are provided with threaded bores are tightened by means of screws 70*a* and 70*b*. The desired angular position of the holding arm 66 (and hence also of the finger 64) can be obtained simply by loosening one screw (for example 70*a*) and correspondingly tightening the other screw (for example 70*b*). All the adjustement members including the actuating elements of the latter are inserted flush inside the gripper arm and do not project beyond the gripper profile at any point.

The finger 64 provided wih a threaded bore 71 is pressed, according to FIG. 11, against the inner shoulder 72 of the holding arm 66 by the screw 65 and is thus held in its operating position. After loosening the screw 65, the finger can shift inside the recess in the holding arm 66, until the desired poitition has been reached and the finger is blocked by tightening the screw 65. In this case also, the entire adjustment mechanism is inserted flush inside the holding arm.

In a preferred embodiment, all the adjustment screws are selected so that they can be actuated with a single spanner. In this embodiment, all the adjustment operations can be carried out from the front side of the machine.

As a result of using keyed gears which can be adjusted with precision, the clearance *b* between the stops 25*a*/25*b* (FIGS. 1 and 7) can be controlled very accurately, so that the blanks which are to be pushed into the closed gripper impart to the latter an opening width which can be exactly predetermined.

As already mentioned in relation to FIGS. 1 to 3, the resultant coupling curve which is described by the lower ends of the gripper arms has outstanding advantages for grasping and again releasing the pressing as well as for by-passing the punch present in the path of the gripper. Three particularly characteristic phases of the gripper motion are represented in FIG. 12, the central position B corresponding to the representation according to FIG. 4.

Figure 12:
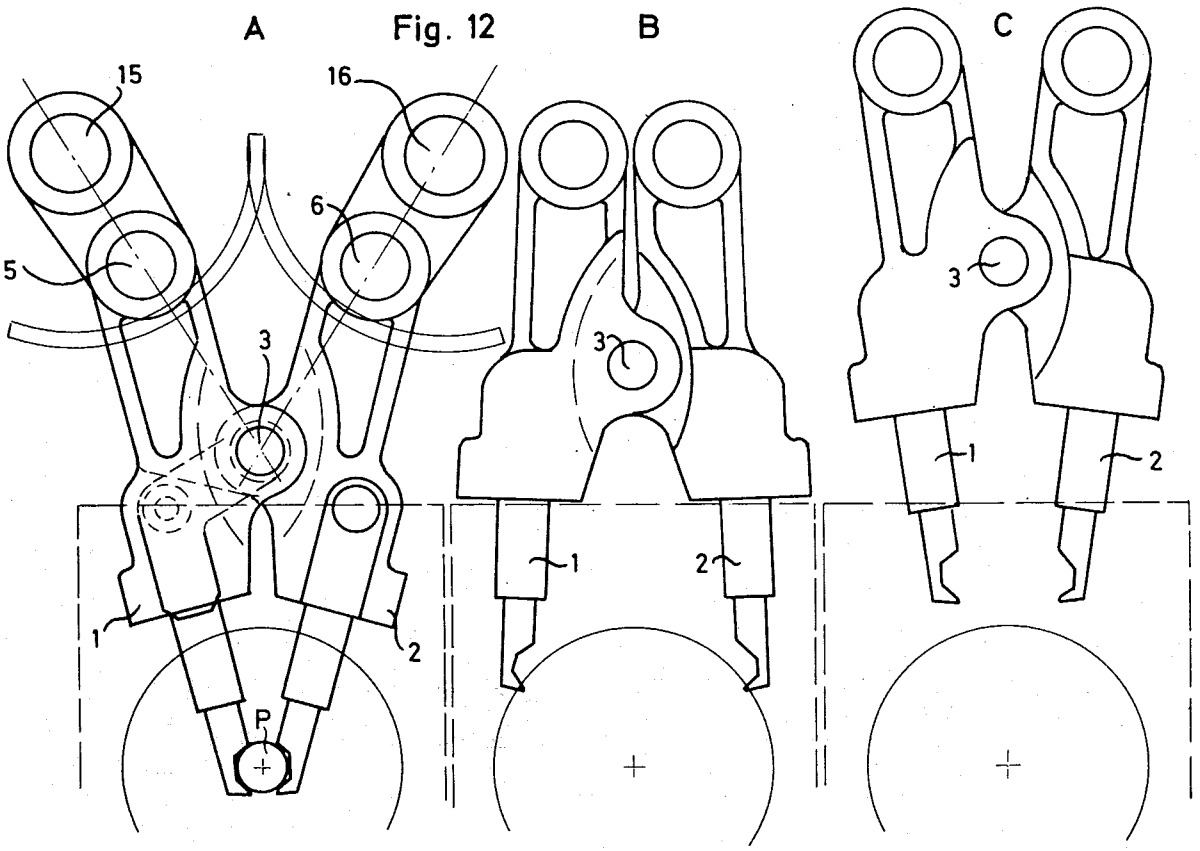
FIG. 12 shows a gripper in three characteristic operating positions.

In the position A according to FIG. 12, the lower end parts of the gripper arms enclose the pressing P which has just been brought to a point in front of the matrix of the upsetting station, in order to be pushed into the matrix by the punch. According to position B, the gripper arms are in the position of maximum extension, whilst position C illustrates the uppermost position of the gripper.

Other elements, for example a belt-driven roller gear, a chain gear, a frictional gear and the like, can also be used in place of the two intermeshed toothed segments 42, 43. It would also be possible to locate a rack, fitted on both sides with teeth, between the two toothed segments, the rack taking the toothed segments along during its vertical reciprocating motion.

If the hinge points 5 and 6 are laid out according to FIG. 1, the coupling curve 19 can be varied at will.

Moreover, it is not essential in every case that the guide elements of the gripper arms are shaped as cranks. Thus, the desired positive guiding of the gripper arms can, for example, also be effected by appropriately shaped and arranged slotted links, as is illustrated below by reference to FIG. 13–15.

Figure 13:
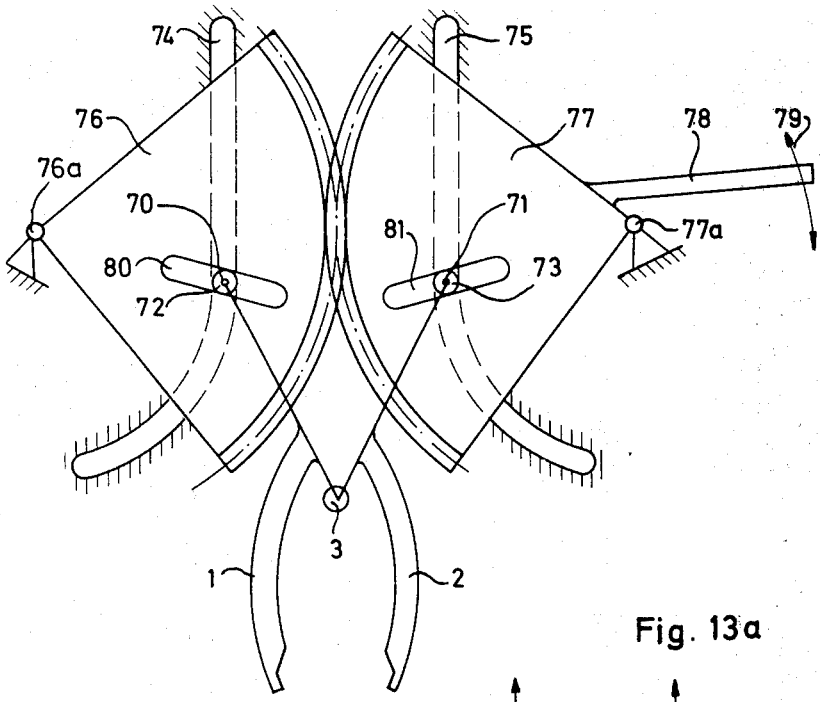
FIGS. 13 – 15 show three further embodiments of the invention.

FIG. 13, analogously to FIGS. 1 to 3, again shows two gripper arms 1 and 2 which can pivot around a common pivot 3. The hinge points 70 and 71 of the two gripper arms are guided, via guide pins 72 and 73, in two guide slots 74/75 which are in a stationary arrangement on the gripper carrier. The guide slots 74 and 75 are mirror images with respect to a common symmetry line; their mutual distance, and thus also their distance from the imaginary symmetry line, increases steadily in the lower sections which face the pair of gripper arms.

Two toothed segments 76/77, whih mesh with each other and can carry out a pivoting motion around the axes 76*a*/77*a*, are superposed on the guide slots 74/75. The toothed segment 77 is driven via a rocking lever 78 which oscillates in the direction of the double arrow 79, whilst the toothed segment 76 is merely taken along.

Figure 13A:
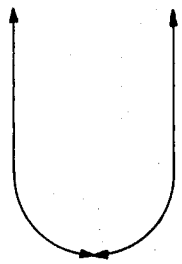

Since the directrices of the guide slots do not coincide with circular arcs around the axes 76*a*/77*a*, the toothed segments 76/77 must be provided with additional guide slots 80/81, into which the guide pins 72/73 can be deflected. The course of motion of the two jaws of the tong, resulting from the positive guiding, can be seen in FIG. 13*a*.

Figure 14:
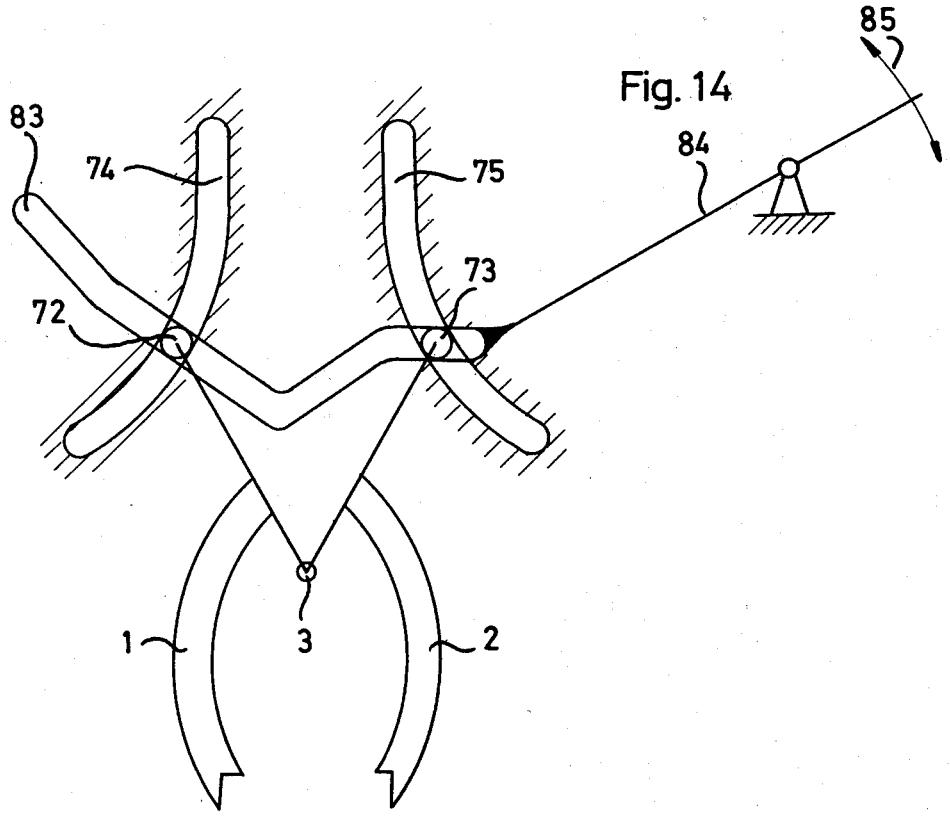

According to FIG. 14, the two guide pins 72/73 are taken along by an oscillating slotted link 83 which has a shape appropriate to the purpose and is set in oscillatory motion by means of a rocking lever 84 in the direction of the double arrow 85. The guide pins and hence the gripper arms 1/2 are forced into the desired motion by the two guide slots 74/75 which are still similar to those in FIG. 13. The special form of the oscillating slotted link 83 has the result that the jaws of the tongs always remain at the same height.

Figure 15:
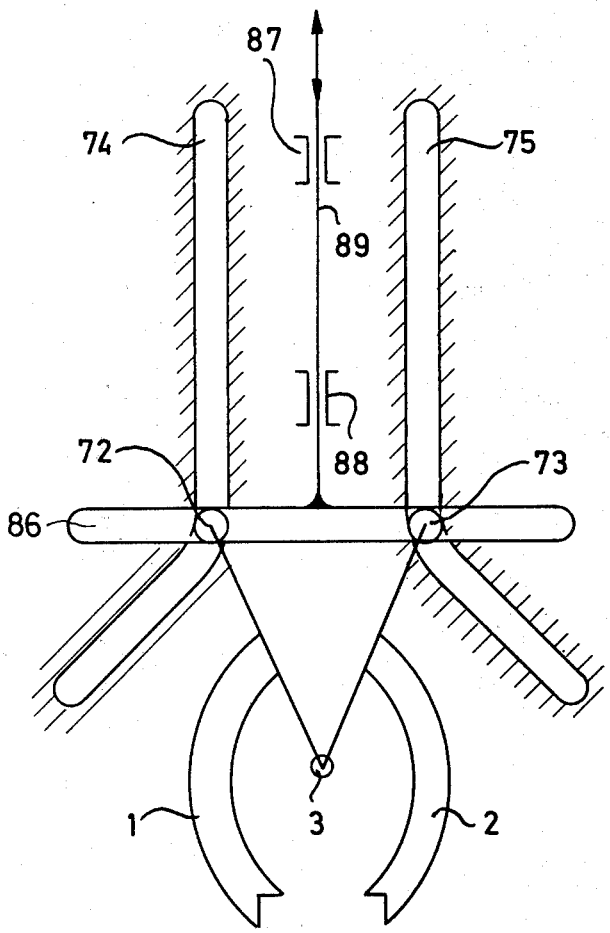

Finally, it would also be possible, for example, to use a vertically guided slotted link 86 (FIG. 15). In this case, the drive is effected by a push rod 89 guided in two bearings 87/88.

I claim:

1. A device for transporting workpieces between upsetting stations in a multi-stage upsetting press, such device comprising: a gripper carrier and at least one gripper on the gripper carrier for carrying workpieces, each gripper comprising a pair of gripper arms movable towards and away from each other to grip and release a workpiece, each gripper arm having first and second spaced ends, means at the first end for gripping a workpiece and a pivot point at the second end thereof, a respective guide element pivotally connected to each arm at the pivot point thereof, the gripper arms further being pivotally connected to one another about a common pivoting axis at a location intermediate their ends which is in triangularly spaced relation to the pivot points of the arms, the guide elements being arranged positively to guide the pivot points to open and close the arms in such manner that as the gripper arms oper they undergo a translatory motion generally towards a line intersecting said pivot points, which translatory motion of the arms is at a minimum as the arms start to open and thereafter increases steadily as the opening motion proceeds.

2. A device according to claim 1 wherein the arrangement is such that when the arms are in closed configuration, the angle between their respective pivot points and the common pivot axis is approximately 90°.

3. A device according to claim 1 wherein the guide elements of each pair of gripper arms have pivotally mounted circular segmental portions which are provided with intermeshed peripheral teeth and the arrangement is such that, when the gripper is in the closed configuration, the pivot axis of each circular poriton is substantially coplanar with both the pivot point of the associated arm and the common pivot axis.

4. A device according to claim 1 wherein each of said guide elements comprises a crank, and including means for driving one of the elements of each pair for periodic oscillating movement to move the gripper arms to the open configuration and means for biasing the other element in such manner as to tend to move the gripper arms to the closed configuration.

5. A device according to claim 4 wherein each crank comprises a crank pin on which the associated gripper arm is pivoted.

6. A device according to claim 4 and including a pair of coaxially spaced shafts, the driven guide element of one gripper being connected to one shaft of the pair and a biased guide element of a further gripper being connected to the other.

7. A device according to claim 6 wherein the driven guide element is connected to the inner of the two shafts, and including a rocking lever on the inner shaft, a cam controlled slave lever, and a part-spherical sliding joint connecting the rocking lever to the slave lever.

8. A device according to claim 7 and including means defining a cylindrical cut-away portion of the rocking lever, a part-spherically shaped portion of the slave lever projecting into the cut-away portion, a lever actuated by the cam and a universal joint connecting the slave lever to the cam-actuated lever.

9. A device according to claim 7 wherein the rocking lever is loosely mounted on the inner shaft which has rigidly connected thereto a dog, which dog is periodically engaged by the rocking lever thereby to drive the inner shaft.

10. A device according to claim 9 in which the arrangement is such that when the gripper arms are in closed configuration a clearance exists between the rocking lever and the dog.

11. A device according to claim 10 and including mutually facing stop surfaces of the gripper arms, which stops limit the movement of the arms towards one another, the clearance between these stops when the gripper arms are gripping a workpiece being less than the clearance between the rocking lever and the dog.

12. A device according to claim 1 and including first and second spaced guide walls of the gripper carrier which extend parallel to the direction of said translatory motion of the carrier, the gripper arms being mounted between said walls in such manner that the axial loads thereon caused during upsetting of a workpiece are transmitted to the guide walls.

13. A device according to claim 12 and including a third guide wall parallel to the first and second guide walls, the guide elements of the gripper arms being located between the second and third guide walls.

14. A device according to claim 13 wherein the guide elements each include a crank pin on which the associated arm is carried, and including aperture defining means in the second guide wall through which the crank pins extend, the gripper arms being retained on the crank pins by the first guide wall, which wall is removable to permit interchange of the gripper arms.

15. A device according to claim 12 wherein the gripper arms are provided with means for adjusting the distance between the workpiece-gripping ends thereof and the common pivoting axis, the adjusting means being flush with the gripper arms to permit the workpiece-gripping ends thereof to be withdrawn into the space between the first and second guide walls.

16. A device according to claim 15 wherein the adjustment means comprises keyed gears.

17. A device according to claim 1 and including slotted links in which the pivot points of the gripper arms are guided.

18. A device according to claim 17 wherein the slotted links each have means defining two guide slots, the mutual separation of which slots increases steadily in the direction of said translatory motion of the arms.

19. A device according to claim 18 wherein the guide elements of each gripper arm comprise intermeshing toothed circular segments each circular segment having means defining a slot therein with the pivot point of the associated gripper arm being constrained to move within said slot and within a further slot defined in the gripper carrier.

20. A device according to claim 18 and including respective slots defined in the gripper carrier in which slots the pivot points are constrained to move, the separation between these slots decreasing in the direction of said translatory motion of the arms and a slotted link for driving the pivot points along said slots.

21. A device according to claim 20 wherein the slotted link has means defining a slot which extends perpendicularly to the direction of said translatory motion of the gripper arms.

* * * * *